United States Patent [19]

Jermunson

[11] 4,430,940

[45] Feb. 14, 1984

[54] FIREARM CARTRIDGE ADAPTER

[76] Inventor: Neil B. Jermunson, Box 3034, Bozeman, Mont. 59715

[21] Appl. No.: 393,131

[22] Filed: Jun. 28, 1982

Related U.S. Application Data

[63] Continuation-in-part of Ser. No. 168,112, Jul. 14, 1980, abandoned.

[51] Int. Cl.[3] ..... F42B 5/02; F42B 9/02

[52] U.S. Cl. ..... 102/446

[58] Field of Search ..... 102/444–446; 42/77

[56] References Cited

U.S. PATENT DOCUMENTS

| | | | |
|---|---|---|---|
| 803,983 | 11/1905 | Brayton | 102/446 |
| 1,517,702 | 12/1924 | Brubaker | 102/446 |
| 2,107,034 | 2/1938 | Guthrie | 102/446 |
| 2,196,136 | 4/1940 | Wood | 102/446 |
| 2,321,737 | 6/1943 | Engel | 102/446 |
| 3,388,665 | 6/1968 | Koehler | 102/446 |

FOREIGN PATENT DOCUMENTS

| | | | |
|---|---|---|---|
| 1703461 | 12/1971 | Fed. Rep. of Germany | 102/446 |

*Primary Examiner*—Harold J. Tudor
*Attorney, Agent, or Firm*—Arthur L. Urban

[57] ABSTRACT

A cartridge adapter for a firearm including a chamber, a barrel and a center firing pin, the cartridge adapter including a body portion with an axial passage including a first passage section extending from the free end of a smaller cylindrical outer section, a second passage section extending from the free end of a larger cylindrical outer section, a shoulder section adjacent the internal end of the second passage section, a third passage section slightly larger than the first passage section extending from the shoulder section toward the first passage section, a fourth tapered passage section joining adjacent ends of the first and third passage sections, a firing assembly disposed within and having a diameter and a length substantially the same as that of the second passage section, the firing assembly including a breech block member and a firing pin extension member, the breech block member including a throughbore extending from a central point on the free end of the breech block member to a peripheral point on the opposite end of the breech block member, the breech block member having a smooth cylindrical outer surface along substantially its entire length except for a transverse annular recess intermediate the length thereof, the firing pin extension member being disposed within the throughbore and extending from one end thereof to the opposite end thereof, the firing pin extension member having a smooth cylindrical outer surface, an O-ring disposed within the annular recess and contacting the second passage section throughout its length and further contacting both the second passage section and the firing pin extension member along a portion of its length.

5 Claims, 3 Drawing Figures

FIREARM CARTRIDGE ADAPTER

This application is a continuation-in-part of pending application Ser. No. 168,112, filed July 14, 1980.

This invention relates to a novel firearm cartridge adapter and more particularly relates to a new auxiliary cartridge for firearms.

Owners of high power guns used for big game hunting purchase and use many rounds of ammunition annually. While the quantity of ammunition actually used for hunting purposes is small, gun owners use much more ammunition for non-hunting shooting. In order for a shooter to maintain his proficiency with a particular gun, he must fire many practice rounds during the off-season. Also, since gun owners take great pride in their guns, they do off-season shooting purely for the pleasure that they derive from this activity.

One of the important considerations in the amount of shooting that a gun owner does throughout the year is the cost of the ammunition. Since the gun is a high power gun of the type used in big game hunting, the cost of each cartridge is appreciable. When the unit cost is multiplied by the hundreds of rounds fired by each shooter, the annual expense for ammunition used by an individual is quite large. While some gun owners may not be concerned about the substantial expenditures for ammunition, others may be faced with a difficult choice in the matter. Either they must limit the amount of practice they do to keep ammunition cost at a reasonable level with a possible adverse effect on their proficiency with the gun or alternatively, they can reduce their expenditures in other areas of their lives so that they can afford the high cost of the ammunition.

A variety of proposals have been made in an attempt to lower ammunition costs. The use of lighter loads reduces costs slightly. Also, it has been proposed to utilize cartridge adapters which have an outside configuration that matches the chamber of the gun. The cartridge adapters have an axial bore of a size to receive a .22 cartridge.

Some of the cartridge adapters are designed to place the .22 cartridge at the rear of the adapter with the rear of the .22 cartridge flush with the back of the adapter. With this design, the fired .22 bullet must travel through the remainder of the passage of the cartridge adapter before it reaches the rifling of the gun barrel. The necessity for traveling through the adapter passage significantly changes the ballistics of the fired bullet. The velocity of the bullet and its accuracy can be substantially reduced.

Another cartridge adapter design positions the .22 cartridge at the forward end of the adapter with a firing spacer disposed between the rear of the .22 cartridge and the back of the adapter. One model of this design requires the use of center fire .22 cartridges and thus is more costly. To allow the use of rim fire .22 cartridges, a different design utilizes a firing spacer with a pin extension located on the periphery of the spacer.

With both of the above adapters, one of the limitations is the length of the spacer. If the spacer is of considerable length, the mass of the spacer may become a problem. The firing pin of the gun must have sufficient striking force to drive the massive spacer forward at a velocity that will fire the .22 cartridge properly. If the spacer does not have this velocity a misfire will result. In addition, the use of a massive spacer may cause more wear and damage to the firing pin of the firearm.

To reduce the length of the spacer and thus the mass thereof requires that the .22 cartridge be placed more rearward in the adapter passage. This reduces accuracy and may prevent the cartridge adapter from feeding through the magazine of the firearm properly. Thus, there is no cartridge adapter available on the market that provides good accuracy with problem-free cartridge feeding and a minimum of misfires.

The present invention provides a novel cartridge adapter with advantages not available with previous cartridge adapters. The cartridge adapter provides improved accuracy as compared with other adapters. The cartridge adapter of the invention feeds through the magazine of a firearm smoothly. The cartridge adapter significantly reduces the mass that must be moved to fire the .22 cartridge and thus the force required of the firearm firing pin. Furthermore, because the force that must be applied to the firing pin is significantly less, there is less chance for misfires. The cartridge adapter of the invention also provides easy extraction of the fired cases.

The cartridge adapter of the invention is simple in design and relatively inexpensive to manufacture. The adapter can be fabricated from commercially available materials employing conventional cartridge forming techniques and/or metal working techniques.

Other benefits and advantages of the novel cartridge adapter of the present invention will be apparent from the following description and the accompanying drawings in which.

Figure 1:
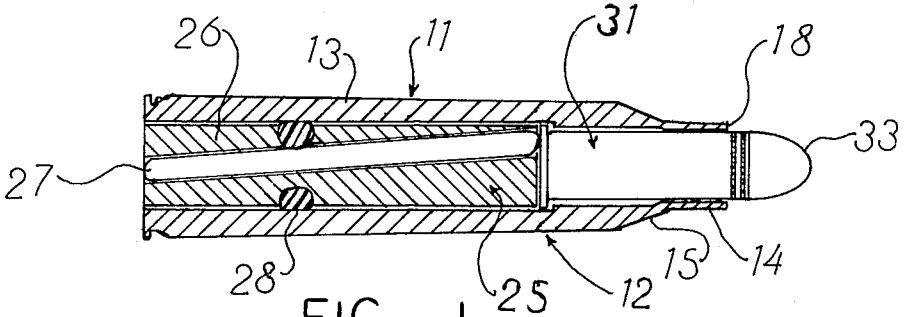
FIG. 1 is a side elevation in section of one form of the cartridge adapter of the invention with a smaller diameter cartridge in place.
Figure 3:
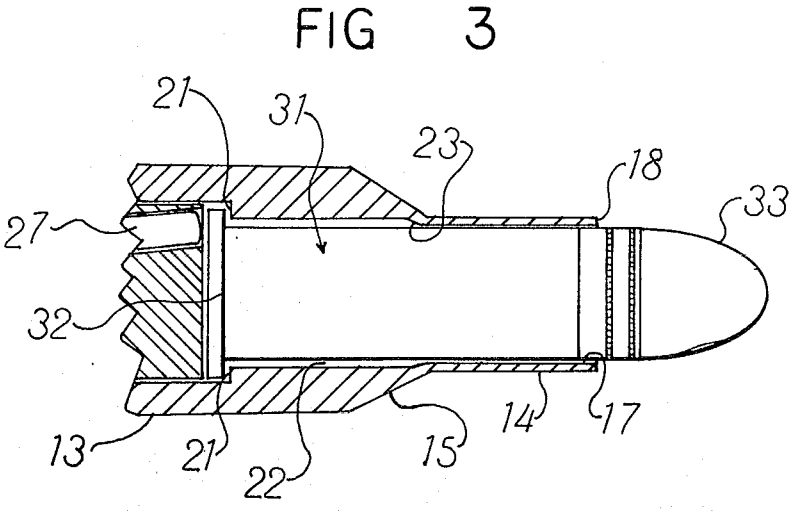
FIG. 3 is an enlarged fragmentary side view of the cartridge chamber portion of the cartridge adapter shown in FIG. 1.
Figure 2:
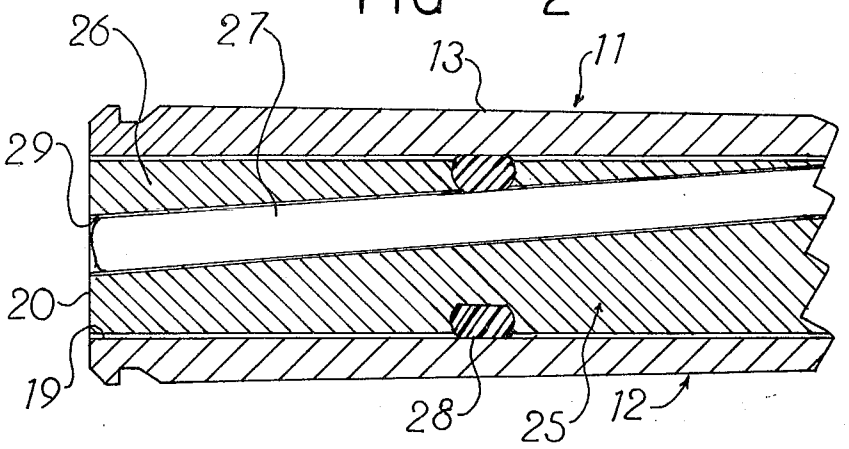
FIG. 2 is an enlarged side view of the firing assembly portion of the cartridge adapter shown in FIG. 1.

As shown in the drawings, one form of the novel cartridge adapter 11 of the invention includes a body portion 12 having an outer surface with cylindrical sections 13, 14 and 15 of differing outer diameters. The body portion 12 is formed to provide intimate contact with a chamber of a firearm (not shown). The larger section 13 of the cylindrical outer sections is joined to the smaller section 14 through a tapered intermediate section 15.

An axial passage through the body portion 12 includes a first passage section 17 which extends from the free end 18 of the smaller cylindrical outer section 14 to the opposite end of the smaller section. A second passage section 19 through the body portion 12 extends from the free end 20 of the larger cylindrical outer section 13 toward the first passage section 17 but terminates short of the inner end of the larger cylindrical outer section 14.

A shoulder section 21 is disposed adjacent the internal end of the second passage section 19. A third passage section 22 extends from the shoulder section 21 toward the inner end of the first passage section 17. A fourth tapered passage section 23 connects the adjacent ends of the first passage section 17 and the third passage section 22.

The first passage section 17 has a diameter substantially the same as that of a smaller diameter cartridge case. Also, the first and third passage sections 17 and 22 and the tapered fourth passage section 23 that connects the first and third sections together have a length substantially the same as that of the smaller diameter cartridge case.

As shown in the drawings, third passage section 22 has a diameter slightly larger than that of first passage section 17. This construction provides increased space around the rear portion of the case of the smaller diameter cartridge. The increased space permits the cartridge adapter to expand on firing to fit the chamber of the firearm in which it is fired and still permits easy extraction of the fired smaller diameter cases.

The diameter of smaller passage section 17 is sufficient to allow the smaller diameter cartridge to be inserted therein with a small tolerance. Third passage section 22 is slightly larger in diameter, advantageously about 5% larger. For example, if smaller section 17 is 0.222 inch in diameter, third section 22 preferably is about 0.01 inch larger, that is, about 0.230 to 0.234 inch. The angle of the tapered intermediate section 23 advantageously is about 10° to 20° depending on the length of the taper and preferably about 15°.

Cartridge adapter 11 of the invention also includes a firing assembly 25. The firing assembly 25 which is disposed within second passage section 19 has a diameter and length substantially the same as that of the second passage section. The firing assembly 25 includes a breech block member 26 and a firing pin extension member 27.

The breech block member 26 includes a throughbore 29. The throughbore 29 extends from a central point on the free end of the breech block member 26 to a peripheral point on the opposite end of the breech block. The breech block member 26 has a smooth cylindrical outer surface along substantially its entire length except for a transverse annular recess intermediate the length thereof. The annular recess has a depth sufficient to intersect the throughbore 29 at a point along its length.

The firing pin extension member 27 is disposed within the throughbore 29 and extends from one end of the breech block member 26 to the opposite end thereof. The firing pin extension member 27 also has a smooth cylindrical outer surface.

An O-ring 28 is disposed within the annular recess of the breech block member 26. The O-ring 28 contacts the second passage section 19 throughout its length. In addition, the O-ring contacts both the second passage section 19 and the firing pin extension member 27 along a portion of its length.

This disposition of the O-ring 28 provides a convenient and simple means for retaining the breech block 26 and the firing pin extension member 27 in their proper positions with respect to each other and also with respect to the body portion 13. At the same time, the O-ring arrangement provides limited restriction of the respective components so that some movement can be achieved when desired or required such as during assembly or replacement of components.

The cartridge adapter of the invention may be formed of one or more of a number of materials such as various metals, alloys and the like. Advantageously, the body portion is formed of a steel alloy, the breech block member of steel or aluminum and the firing pin of an untempered oil hardening steel, either hardened or unhardened. Under certain conditions, it may be possible to form components of one of the new high strength plastic materials.

In the use of the cartridge adapter of the invention as shown in the drawings, a small diameter cartridge such as a .22 cartridge 31 is inserted into the open rear end of adapter 11. Then, firing assembly 25 is inserted behind the .22 cartridge. The firing assembly 25 is inserted with an orientation such that the end of the breech block 26 that remains visible has the firing pin extension 27 at the center.

The firing assembly 25 is pushed forward until the rear 32 of the smaller cartridge bears against shoulder section 21 and the bullet 33 extends from the end of the adapter. At this point, the rear of the firing assembly and the rear of the adapter are flush. O-ring 28 surrounding the breech block 26 holds the breech block and the firing pin extension 27 in position. A number of adapters can be assembled in the same manner to provide a supply of ammunition for a shooting venture.

The cartridge adapters can be loaded into the magazine of a firearm which accommodates the adapters and the firearm shot. The adapters feed through the magazine smoothly without jamming. When the shooting is completed, the fired adapters can be reloaded easily by simply pushing the .22 cartridge case rearwardly through the passage of the adapter. This overcomes the resistance of O-ring 28 and allows the firing assembly 25 to be forced from the adapter. When the passage is clear, a new .22 caliber cartridge can be inserted into the passage and properly oriented by inserting the firing assembly after it. The above sequence can be repeated for many cycles without damage to the firearm, the adapter or the components thereof.

The above description and the accompanying drawings show that the present invention provides a novel cartridge adapter which can be used to fire small diameter cartridges in a firearm that normally utilizes larger cartridges of approximately the same caliber. The cartridge adapter of the invention provides a convenient means for a shooter to enjoy his firearm at substantially less cost for ammunition than using the larger cartridge ammunition required by his firearm. This enables the shooter to enjoy more practice with his firearm.

The cartridge adapter of the invention can be fed through the magazine of a firearm smoothly. Also, the cartridge adapter provides improved shooting accuracy as compared with previous adapters. The adapter significantly reduces the mass that must be moved to fire small cartridges so there is less chance of misfires.

The cartridge adapter of the invention is simple in design and can be fabricated from commercially available materials using conventional manufacturing techniques and semi-skilled labor. The adapter can be manufactured relatively inexpensively so a shooter can afford an adequate supply of adapters at a reasonable cost.

It will be apparent that various modifications can be made in the particular cartridge adapter described in detail above and shown in the drawings within the scope of the invention. For example, the size and configuration of components can be modified to meet specific requirements. Therefore, the scope of the invention is to be limited only by the following claims.

I claim:

1. A cartridge adapter for a firearm including a chamber, a barrel and a center firing pin, said cartridge adapter including a body portion having an outer surface with cylindrical sections of differing outer diameters, said body portion being capable of intimate contact with said chamber of said firearm, a smaller of said cylindrical outer sections being joined to a larger cylindrical outer section through a tapered intermediate outer section, an axial passage through said body portion including a first passage section extending from the free end of said smaller cylindrical outer section to the opposite end thereof, a second passage section within said body portion extending from the free end of said larger cylindrical outer section toward said first passage section but terminating short of the opposite end of said larger cylindrical outer section, a shoulder section adjacent the internal end of said second passage section, a third passage section slightly larger than said first passage section extending from said shoulder section toward the inner end of said first passage section, a fourth tapered passage section joining the adjacent ends of said first and third passage sections, said fourth passage section being disposed adjacent the juncture of said smaller cylindrical outer section and said tapered intermediate outer section, said first passage section having a diameter substantially the same as that of a smaller diameter cartridge case, said first, third and fourth passage sections together having a length substantially the same as that of said smaller diameter cartridge case, a firing assembly disposed within said second passage section having a diameter and a length substantially the same as that of said second passage section, said firing assembly including a breech block member and a firing pin extension member, said breech block member including a throughbore, said throughbore extending from a central point on the free end of said breech block member to a peripheral point on the opposite end of said breech block member, said breech block member having a smooth cylindrical outer surface along substantially its entire length except for a transverse annular recess intermediate the length thereof, said annular recess having a depth sufficient to intersect said throughbore at a point therealong, said firing pin extension member being disposed within said throughbore and extending from one end thereof to the opposite end thereof, said firing pin extension member having a smooth cylindrical outer surface, an O-ring disposed within said annular recess of said breech block member, said O-ring contacting said second passage section throughout its length and further contacting both said second passage section and said firing pin extension member along a portion of its length; whereby inserting a smaller diameter cartridge into the free end of said second passage section and advancing same until the rear end of said cartridge bears against said shoulder section and the bullet thereof extends from the free end of said first passage section, inserting said firing assembly into the free end of said second passage section to bear against said rear end of said smaller cartridge, and said cartridge adapter is inserted into a firearm chamber, the firing of said firearm will cause the firing pin thereof to strike the exposed end of said firing pin extension member driving same against the periphery of the rear of said smaller diameter cartridge to fire same and cause the bullet thereof to be forced through and from the barrel of said firearm.

2. A cartridge adapter according to claim 1 wherein said third passage section has a diameter about 5% larger than that of said first passage section.

3. A cartridge adapter according to claim 1 wherein said third passage section has a diameter about 0.01 inch larger than that of said first passage section.

4. A cartridge adapter according to claim 2 wherein said fourth tapered section connecting said first and third passage sections is at an angle between about 10° and 20° with respect to said sections.

5. A cartridge adapter according to claim 4 wherein said tapered section connecting said first and third passage sections is at an angle of about 15° with respect to said sections.

* * * * *